United States Patent [19]

Froidevaux

[11] 3,953,907

[45] May 4, 1976

[54] TWIN TOOTHBRUSHES

[76] Inventor: Camille Henri Froidevaux, P.O. Box 63, Lookout Mountain, Tenn. 37350

[22] Filed: Feb. 26, 1975

[21] Appl. No.: 553,221

[52] U.S. Cl. ..... 15/167 A

[51] Int. Cl.[2] ..... A46B 9/04

[58] Field of Search ..... 15/167 R, 167 A, 160, 15/106

[56] References Cited

UNITED STATES PATENTS

| | | | |
|---|---|---|---|
| 741,722 | 10/1903 | Ryder et al. | 15/167 A |
| 1,025,751 | 5/1912 | Kretzschmar | 15/167 A |
| 2,528,992 | 11/1950 | Barr | 15/167 A |
| 3,067,447 | 12/1962 | Birch | 15/167 A |

FOREIGN PATENTS OR APPLICATIONS

| | | | |
|---|---|---|---|
| 418,962 | 3/1947 | Italy | 15/167 A |
| 17,726 | 9/1898 | Switzerland | 15/167 A |
| 19,465 | 10/1895 | United Kingdom | 15/167 A |

*Primary Examiner*—Peter Feldman
*Attorney, Agent, or Firm*—Stevens, Davis, Miller & Mosher

[57] ABSTRACT

This document discloses a toothbrush having opposed bristles rigidly separated from the bifurcated end of a handle in such spaced relation as to accommodate teeth of different thicknesses for vertical brushing.

2 Claims, 5 Drawing Figures

TWIN TOOTHBRUSHES

This invention relates to tooth brushes and more particularly to tooth brushes capable of simultaneously brushing both sides of a tooth by a vertical stroke which is effective to cleanse between the teeth by preventing the material sought to be removed from being pushed back and forth.

While a number of patents have been granted for tooth brushes intended to act simultaneously on both sides of a tooth, these brushes have not enjoyed wide acceptance principally because they are intended to brush horizontally rather than vertically. Typical of these are the constructions found in U.S. Pat. Nos. 1,908,509; 3,065,479; 3,067,447; 2,445,657; and 1,776,312. A review of these patents reveals that they deal with brushes primarily arranged to fit the contours of a line of teeth as is necessary in horizontal brushing. To this end, the brush containers are not rigid, but pivoted; see each of U.S. Pat. Nos. 3,067,447, 1,776,312 and 3,065,479. U.S. Pat. No. 1,908,509 is concerned with brushing the outer, inner and top surfaces of a tooth at the same time which is necessarily a horizontal brushing.

As distinguished from the prior art, the brushes of the present invention are rigidly mounted in relation to each other so that the free ends of the bristles of the facing brushes are spaced apart less than the width of a tooth. The spacing of the bristles is such that when the brush is astride a tooth, whether it be a thick tooth such as a molar, or a thinner tooth such as an incisor, the bristles are equally biased and therefore brush with approximately equal force.

Other objects and advantages of the present invention will be apparent upon consideration of the following detailed description in conjunction with the annexed drawings wherein.

Figure 1:
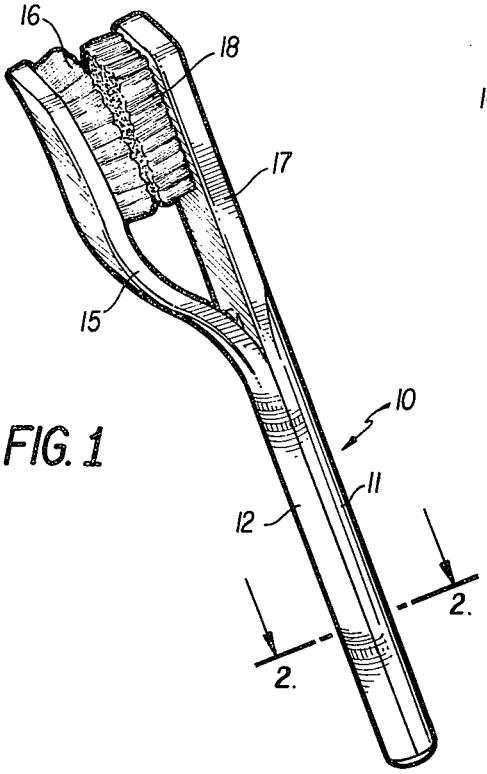
FIG. 1 is a perspective view of a toothbrush made according to the present invention.
Figure 2:
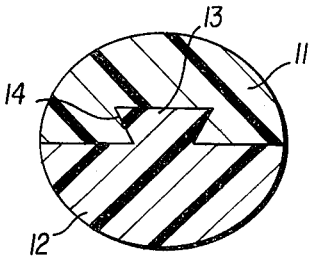
FIG. 2 is a view in section taken on line 2 — 2 of FIG. 1, but drawn to an enlarged scale and turned 90° better to illustrate the construction of the handle of the toothbrush of FIG. 1.
Figure 3:
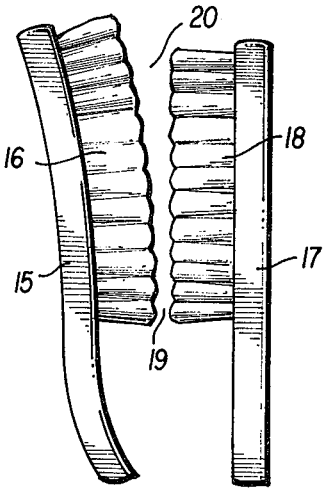
FIG. 3 is a fragmentary view in elevation of the disposition of the bristles of the toothbrush of FIG. 1.

Referring now in detail to FIGS. 1, 2 and 3, the toothbrush shown is comprised of a handle 10 made of two parts 11 and 12 connected together by an elongated dovetail joint comprised of a tongue 13 on the inner face of portion 12 fitting in a complementary groove 14 on the inner face of the handle portion 11.

As shown in FIG. 1, an arm 15 is integral with handle portion 12 and forms an acute angle with the longitudinal axis of the handle, having rigidly fixed bristles 16 extending therefrom. Integral with handle portion 11 is a further linear section forming an arm 17 having bristles 18 rigidly fixed therein and extending toward the bristles 16.

Figure 5:
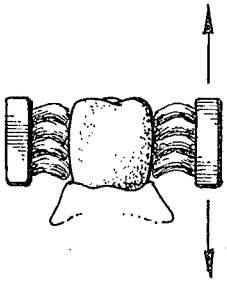
FIG. 5 is a fragmentary view showing how the brushes of FIGS. 1 and 4 are used in cleaning the teeth.

The location and spacing of the bristles in relation to each other is an important part of the present invention because the toothbrush as shown in FIG. 1 is intended to be so manipulated as to move vertically on the tooth, see FIG. 5. In order to obtain proper cleansing and gum stimulation, it is important that the free ends of the bristles 16 and 18 be spaced apart a distance less than the width of a tooth so that in brushing the degree of firmness is a function of the physical properties of the bristles. It is also very important that the bodies of bristles 16 and 18 be rigidly fixed to the respective arms 15 and 17 so that they cannot pivot or slide but must exactly follow the stroke imported to the arm. Note in FIG. 3 that not only is the space between bristles at 19 less than the thickness of a rather narrow tooth, such as an incisor, but that the space is wider at 20 toward the free ends of the arms 15 and 17 but is nevertheless narrower than the thickness of a tooth such as a molar. This spacing allows one to exert identical pressures on teeth of different dimensions by appropriately locating the tooth to be cleaned in the space 19 or 20 according to the thickness of the tooth being cleaned.

It is also a point of this invention that the space between the bristles at 20 is at the free end of the arms 15 and 17. This is because the thicker teeth such as molars are situated at the back of the mouth so that the cleaning required must be close to the free end of the arms. On the other hand, the incisors which can be gripped in the area 19 are toward the front of the mouth where there is room to accomodate the portions of the brush which project beyond the cleaning area.

Figure 4:
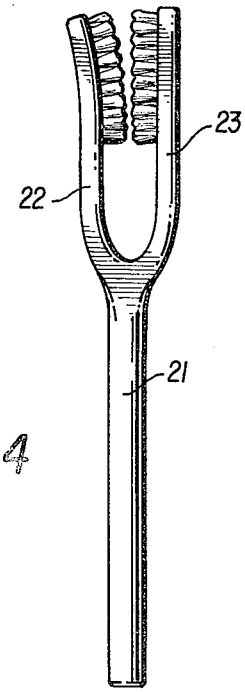
FIG. 4 is a modified form of toothbrush made according to the present invention.

What has been said above with respect to the brush locations of FIG. 3 is equally applicable to FIG. 4, except that in FIG. 4 the handle 21 is solid and both of the arms 22 and 23 form an acute angle to the longitudinal axis of the handle 21 and are integral with it. The spacing and arrangement of the brushes, however, is substantially identical to FIG. 3.

The FIG. 1 arrangement, because of the dovetail tongue and groove, permits the sections 11 to 17 which form the linear part of the toothbrush, to be detached from the section 12 to 15 which form the non-linear part of the toothbrush. This enables the part composed of sections 11, 17 and 18 to be utilized as a conventional toothbrush.

What is claimed is:

1. A toothbrush comprising a handle, having first and second bifurcated arms projecting in mutually spaced relation therefrom with the first arm formed as a planar continuation of the said handle and the second adjacent arm formed at an acute angle to the first arm;

bristles of substantially equal length rigidly fixed to and extending from said arms toward one another to define therebetween a space longer but narrower than the width of a tooth, said space being wider toward the free ends of said arms and narrower toward said handle, whereby the brush may be pushed astride the teeth and thereafter manipulated in vertical strokes to clean them, said handle comprising two parts releasably interconnected to each other by means extending longitudinally along the handle, one of said parts being integral with one of said arms and the other of said parts being integral with the other of said arms, whereby when said parts and said arms integral therewith are disconnected, the first arm and the part integral therewith may be individually used for brushing of the teeth.

2. A toothbrush as claimed in claim 1, in which said means comprises a dovetail tongue and groove.

* * * * *